US007677936B2

(12) United States Patent
Sato et al.

(10) Patent No.: US 7,677,936 B2
(45) Date of Patent: Mar. 16, 2010

(54) PLUG CONNECTOR HAVING RETAINER ATTACHED MOLD CASE

(75) Inventors: Takeshi Sato, Tokyo (JP); Taku Kawano, Tokyo (JP)

(73) Assignee: Honda Tsushin Kogyo Co., Ltd., Tokyo (JP)

( * ) Notice: Subject to any disclaimer, the term of this patent is extended or adjusted under 35 U.S.C. 154(b) by 0 days.

(21) Appl. No.: 12/230,758

(22) Filed: Sep. 4, 2008

(65) Prior Publication Data

US 2009/0068904 A1 Mar. 12, 2009

(30) Foreign Application Priority Data

Sep. 6, 2007 (JP) ..... 2007-231337

(51) Int. Cl.
*H01R 13/46* (2006.01)

(52) U.S. Cl. ..... 439/892; 439/357; 439/607.51

(58) Field of Classification Search ..... 439/892, 439/607.41, 607.44, 607.47, 607.5, 607.51, 439/607.53, 607.55–607.58, 357–358
See application file for complete search history.

(56) References Cited

U.S. PATENT DOCUMENTS 4,889,503 A * 12/1989 Philippson et al. ..... 439/607.45
4,946,404 A * 8/1990 Takenouchi et al. ..... 439/352
6,196,874 B1 * 3/2001 Wu ..... 439/607.58
6,319,043 B1 * 11/2001 Takatsuki et al. ..... 439/358
6,561,834 B2 * 5/2003 Chen ..... 439/358
6,960,025 B2 * 11/2005 Gurreri ..... 385/58
7,066,768 B2 * 6/2006 Kameyama ..... 439/660
7,104,829 B2 * 9/2006 Volpone et al. ..... 439/358
7,252,548 B2 * 8/2007 Huang ..... 439/607.01

FOREIGN PATENT DOCUMENTS

JP 2005-093149 4/2005

* cited by examiner

*Primary Examiner*—Hae Moon Hyeon
(74) *Attorney, Agent, or Firm*—Wenderoth, Lind & Ponack, LLP.

(57) ABSTRACT

To prevent damage by an external force in a retainer attached mold case of a plug connector including an insulating member having aligned containing holes containing contacts, a shield case surrounding the insulating member, a substantially cylindrical mold case incorporating these therein and having slits for grounding at two side walls thereof and an elastic claw with a lock portion and a lock release portion at an upper face, and a retainer for closing a rear end opening of the mold case excluding a cable inserting portion, a locking projection is projected to a rear side from a rear end portion of the elastic claw, and a float preventing piece for preventing the elastic claw from floating up by engaging with the locking projection is projected from a front end portion of the retainer.

4 Claims, 11 Drawing Sheets

PLUG CONNECTOR HAVING RETAINER ATTACHED MOLD CASE

BACKGROUND OF THE INVENTION

1. Field of the Invention

The present invention relates to a plug connector including a mold case, for use with a wire harness or the like of an automobile.

2. Prior Art

In a prior art configuration, as shown in FIG. 10, a plug connector "A" attached with a cable of a wire harness or the like is constituted by a rectangular slender mold case 100, and a retainer 105 mounted to a rear portion of the mold case. A cable 106 has a plurality of core wires connected to a female contact of an insulating member 107 fixedly attached to inside of the mold case and led out to a rear side of the mold case. The mold case 100 is provided with a slit 101 at a side wall thereof, and a portion of a shield case 103 surrounding the insulating member 107 at an inside thereof is exposed to the outside. Further, an upper portion of the mold case is provided with an elastic claw 102 for connection locking, a projection 102*a* for locking, and a press portion 102*b* for releasing.

A fitting counter of the plug connector "A" coaxial therewith is an adaptor connector "B" soldered onto a printed board 108, and an insulating member 109 fixed integrally with a male contact soldered to the printed board 108 is surrounded by a shield case 110. At an inner space of the insulating member 109, a ground plate 111 to be brought into electric contact with the shield case 103 on a side of the plug connector "A" is attached to a side wall thereof, a lower portion thereof is provided with a guide groove 112, and an upper portion thereof is provided with a lock portion 113 by which the locking projection 102*a* of the elastic claw 102 is locked.

The cable attached plug connector "A" constituted as described above is inserted from an opening portion of the insulating member 109 of the adaptor connector "B", the locking projection 102*a* of the elastic claw 102 is engaged with the lock portion 113 and is inserted to a locking state to be connected, which is a publicly-known example (refer to JP-A-2005-93149).

However, according to the cable attached plug connector "A" of the prior art, as shown in FIGS. 11B and 11C, a projected portion 102*c* is provided at a side face of the elastic claw 102 for preventing the elastic claw 102 from floating up, and a side face thereof is provided with a wall 105*a* for locking, and therefore, the elastic claw 102 can be prevented from floating up. However, the releasing press portion 102*b* on a rear side of the elastic claw 102 is not prevented from turning up at all. Therefore, the elastic claw 102 cannot be completely prevented from floating up.

Further, in order to ground the mold case 100 at the side face, the slit 101 is provided and the shield case 103 and the ground plate 111 are made to be brought into contact with each other, as shown in FIGS. 12A and 12B, by notching to form the slit 101. However, a lower portion 104 of the mold case 100 may become damaged when in a case in which the cable attached plug connector "A" is caught thereby and cannot be smoothly inserted upon insertion of the cable attached plug connector "A" from the opening portion of the insulating member 109, the cable attached plug connector "A" is forcibly screwed in. Further, also in the retainer 105, there is a problem that when a rapid force is exerted to an opening edge portion thereof by the cable 106, the retainer 105 is opened and the retainer per se is damaged.

SUMMARY OF THE INVENTION

Hence, in view of the above-described problem in the prior art, it is an object of the invention to provide a retainer attached mold case that prevents an elastic claw from being damaged in fitting the elastic claw by preventing the elastic claw from floating up and preventing a retainer from being opened and damaged.

A plug connector according to the invention includes: an insulating member having aligned containing holes containing contacts; a shield case surrounding the insulating member excluding a front face thereof; a mold case substantially constituting a cylindrical case that accommodates the insulating member and the shield case at an inner space portion, two side walls of the mold case being formed with grounding slits open to communicate with a front end opening, and an upper face of the mold case including an elastic claw having a lock portion extended to a rear side by being turned back from a front end portion, and a lock release portion; and a retainer for closing a rear end opening of the mold case by excluding a cable inserting portion; wherein a locking projection is projected to a rear side from a rear end portion of the elastic claw, and a float preventing piece for preventing the elastic claw from floating up by being engaged with the locking projection is projected from a front end portion of the retainer.

It is preferable that inner wall faces of upper portions of two side walls of the mold case at the elastic claw are formed with engaging grooves extended in a front and rear direction, and engaging portions fitted to the engaging grooves are formed to project horizontally at two side walls of the float preventing piece.

It is preferable that engaging portions projected to inner sides of the mold case for engaging with the insulating member are respectively provided on upper and lower sides of an opening edge portion of a front end of the mold case, a front end portion of the insulating member is formed with guide grooves respectively engaged with the engaging portions, and an upper portion and a lower portion of the mold case divided by the slit are prevented from being opened in an up and down direction.

According to the retainer attached mold case of the invention, the locking projection is projected to the rear side from the rear end portion of the elastic claw, the float preventing piece for preventing the elastic claw from floating up by engaging with the locking projection is projected from the front end portion of the retainer, and therefore, the elastic claw does not float up and is not damaged even when forcibly screwed in while being fitted.

Further, the engaging grooves extended in the front and rear direction are formed at the inner wall faces of the upper portions of the two side walls of the mold case at the elastic claw, the engaging portions fitted to the engaging grooves are formed to project horizontally at the two side faces of the float preventing piece, and therefore, even when a rapid force by the cable is exerted to the opening edge portion, the retainer per se is not damaged by opening the retainer.

Further, the upper and lower sides of the front end opening edge portion of the mold case are respectively provided with the engaging portions projected to the inner sides for engaging with the insulating member, the guide grooves for respectively engaging the engaging portions are formed at the front end portion of the insulating member, and therefore, a drawback of opening the front portion of the mold case in the up and down direction by the slit is resolved.

DETAILED DESCRIPTION OF THE PREFERRED EMBODIMENTS

Figure 1:
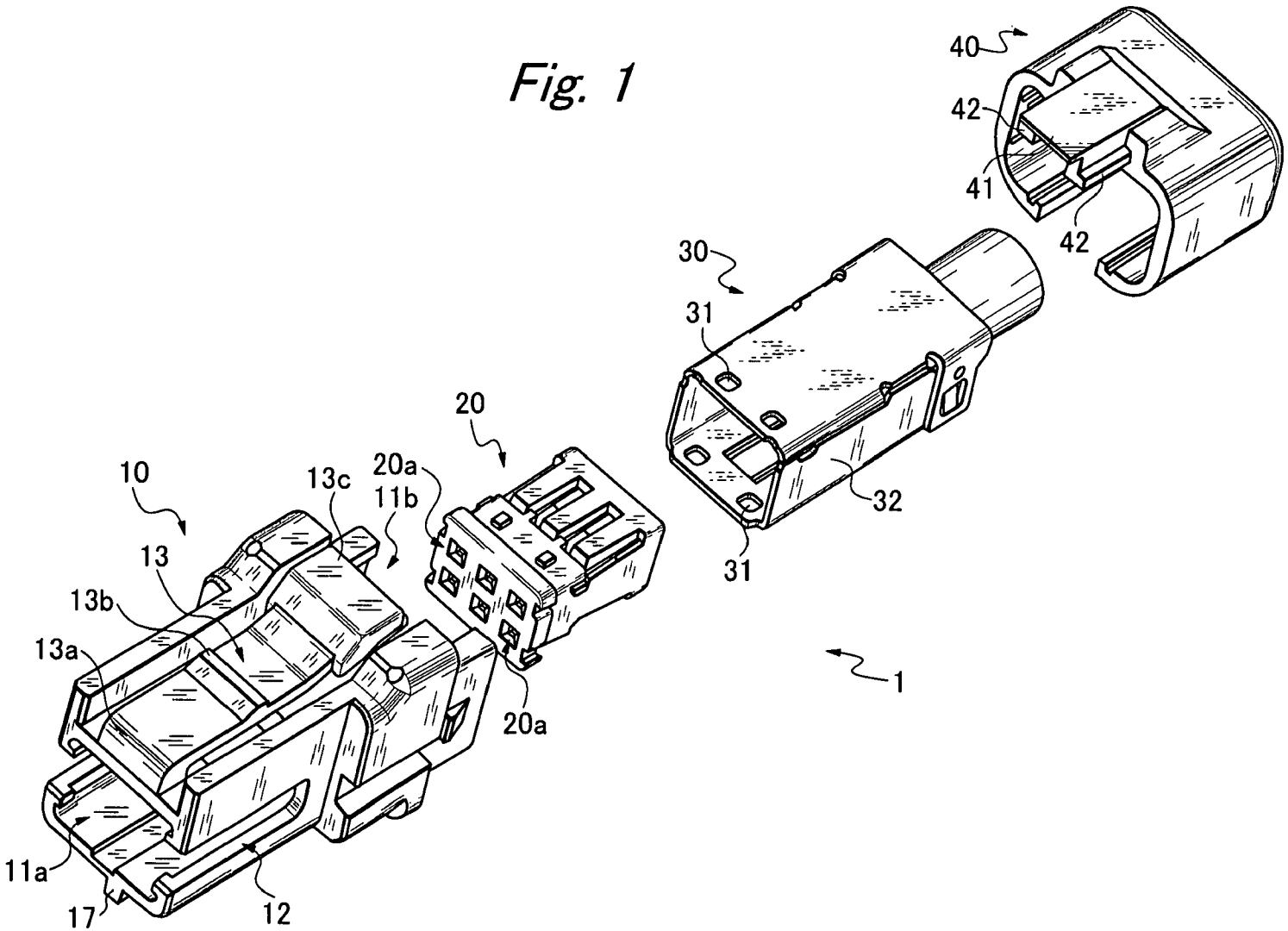
FIG. 1 is a disassembled perspective view showing a plug connector having a mold case attached with a retainer according to an embodiment of the invention.

As shown in FIG. 1, a plug connector 1 according to an embodiment of the invention is constituted by a mold case 10, an insulating member 20 aligned with containing holes 20*a* containing female contacts (not illustrated), a shield case 30 surrounding the insulating member 20 excluding a front face thereof, and a retainer 40 closing a rear end opening 11*b* of the mold case 10 excluding a cable inserting portion. The mold case 10 has a substantially cylindrical shape with an inner space portion that accommodates the shield case 30 and insulating member 20.

Figure 2A:
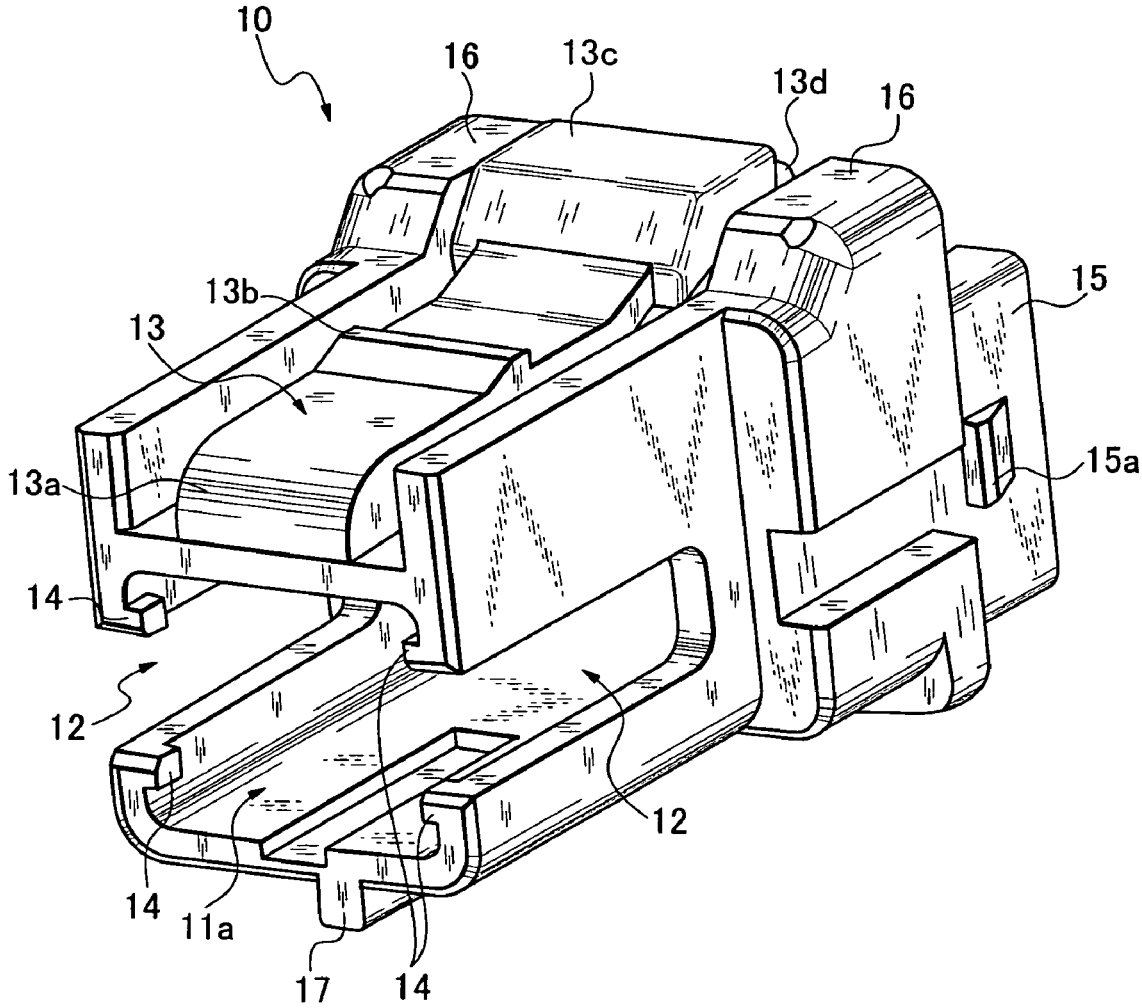
FIG. 2A is a perspective view showing the mold case for the plug connector.
Figure 2B:
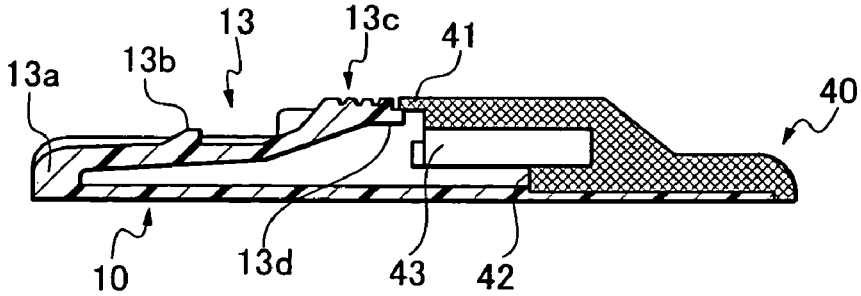
FIG. 2B is a vertical sectional view showing a state of engaging the mold case and the retainer.

As shown in FIGS. 2A and 2B, two side walls of the mold case 10 are formed with grounding slits 12, 12 for that communicate with a front end opening 11*a*. An upper face of the mold case 10 is formed in a recess shape and is provided with an elastic claw 13 extended to a rear side by being turned back from a front end portion 13*a*. Four portions of an edge portion of the opening 11*a* are respectively formed with engaging portions 14 constituted by engaging projections. Further, a side face of a rear end portion 15 has a locking projection 15*a* for locking the retainer 40 when the retainer 40 is closed. A lower face on a front-end side has a downwardly projecting guide projection 17 for use in fitting to an adaptor connector.

The elastic claw 13 includes a projection 13*d* projecting rearwardly from the front end portion 13*a*, a lock release portion 13*c* formed at an upper face of the rear end portion, and an upwardly projecting lock portion 13*b* projected from an upper face of a middle portion. The elastic claw 13 is formed to be moveable in an up and down direction about a base point constituted by the front end portion 13*a* by pressing down the lock release portion 13*c*. Further, the elastic claw 13 is prevented from floating up by engagement of a float preventing piece 41 formed at a front end portion of the retainer 40 with the projection 13*d*.

Figure 3A:
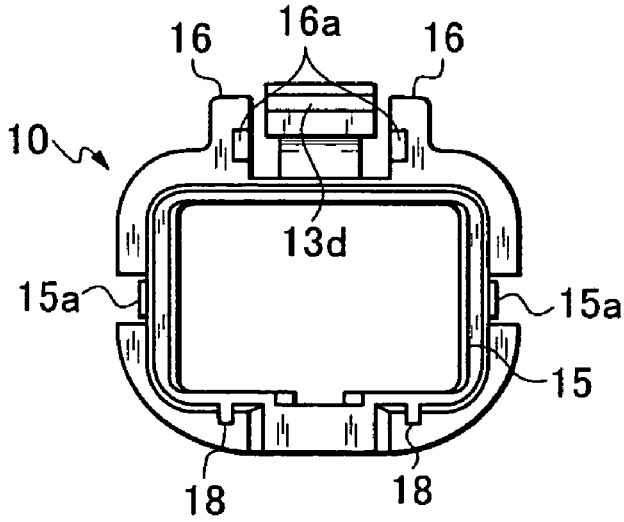
FIG. 3A is a rear view showing the mold case.

As shown in FIG. 3A, inner wall faces of two side wall upper portions 16, 16 of the lock portion 13*b* of the elastic claw 13 arranged at a center of the upper face of the mold case 10 are formed with engaging grooves 16*a*, 16*a* to which engaging portions of the retainer 40 mentioned later are fitted. Further, a lower face of the rear end portion is formed with projected portions 18, 18 fitted to recess grooves formed at an inner side bottom face of the front-end portion of the retainer 40.

Figure 3B:
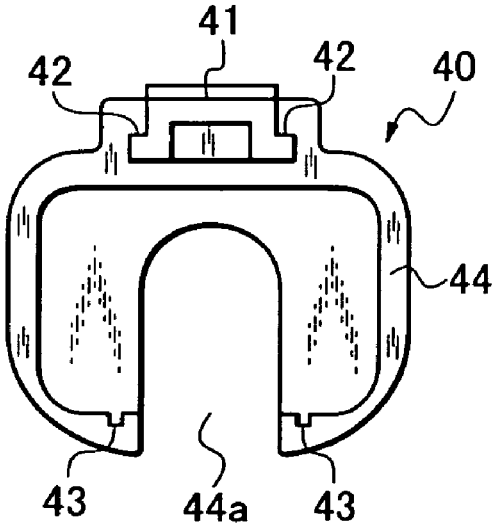
FIG. 3B is a front view showing the retainer.
Figure 4A:
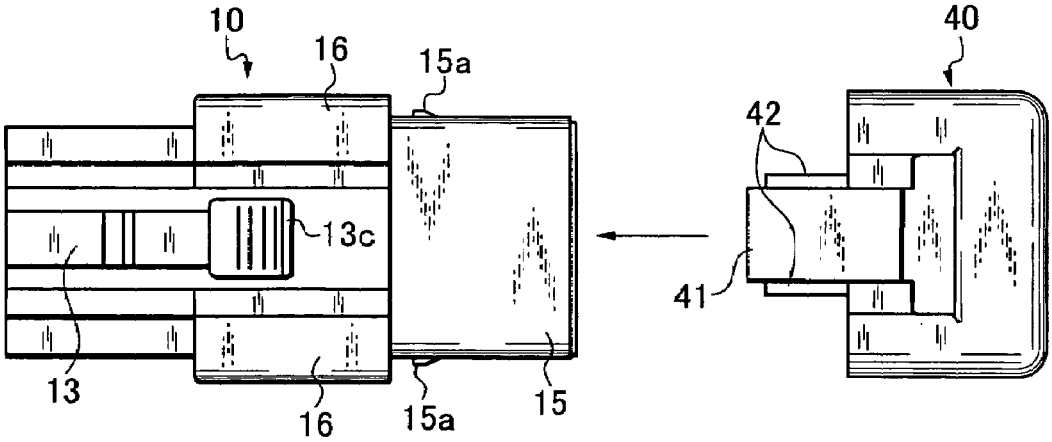
FIGS. 4A and 4B are a plan view and a front view showing a behavior of fitting the mold case and the retainer.
Figure 4B:
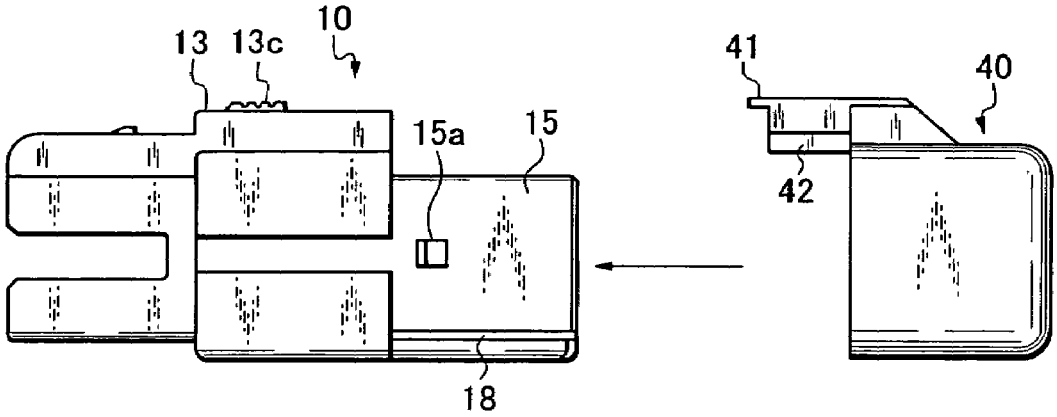
Figure 5A:
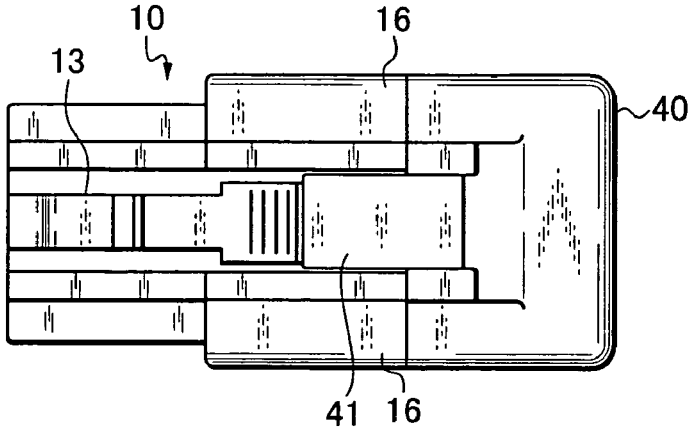
FIGS. 5A, 5B and 5C are a plan view, a rear view, and a side view of the retainer attached mold case.
Figure 5B:
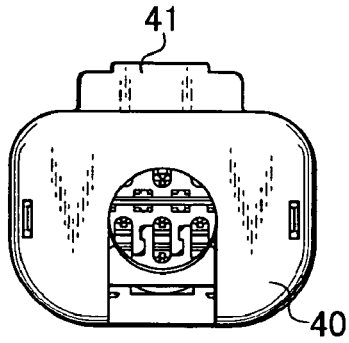
Figure 5C:
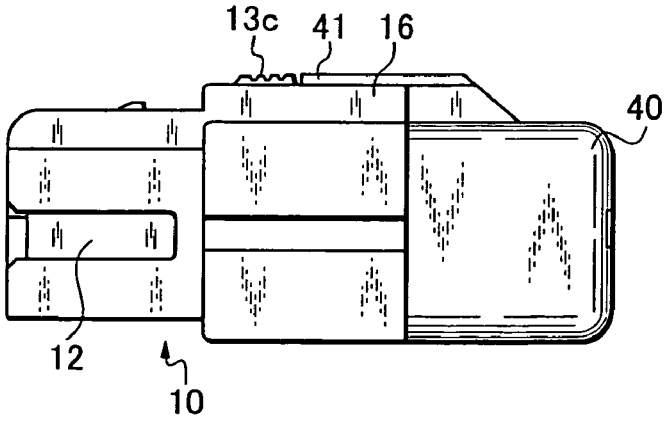

On the other hand, as shown in FIG. 3B, the retainer 40 includes the float preventing piece 41 extending forwardly from a center of the upper portion, and two side faces of the float preventing piece 41 are provided with horizontally projecting engaging portions 42, 42 fitted to the engaging grooves 16*a*, 16*a* of the mold case 10. Further, the inner side bottom face of the front-end portion is formed with recess grooves 43, 43 to which the projected portions 18, 18 of the mold case 10 are fitted. A front end side of the retainer 40 is open so as to fit a rear end portion of the mold case 10, and a rear end side of the retainer 40 is closed by a rear wall 44 formed with a through hole 44*a* for insertion of a cable.

As shown in FIGS. 4A, 4B and 5A-5C, when the retainer 40 is fitted to the rear end portion of the mold case 10 to close the rear end opening 11*b*, the engaging portions 42, 42 at the two side faces of the float preventing piece 41 of the retainer 40 are fitted in the engaging grooves 16*a*, 16*a* of the inner wall faces of the two side wall upper portions 16, 16 of the mold case 10. Further, at the same time, the projected portions 18, 18 of the mold case 10 are fitted in the recess grooves 43, 43 formed in the inner side bottom face of the front end portion of the retainer 40. That is, the two members are fitted together at both upper and lower sides thereof. The engagement of the retainer 40 with the mold case 10 becomes solid, and even when a rapid force is exerted to an edge portion of the through hole 44*a* of the rear wall 44 by a cable being inserted through the through hole 44*a*, the retainer is not damaged by opening the retainer 40.

Figure 6:
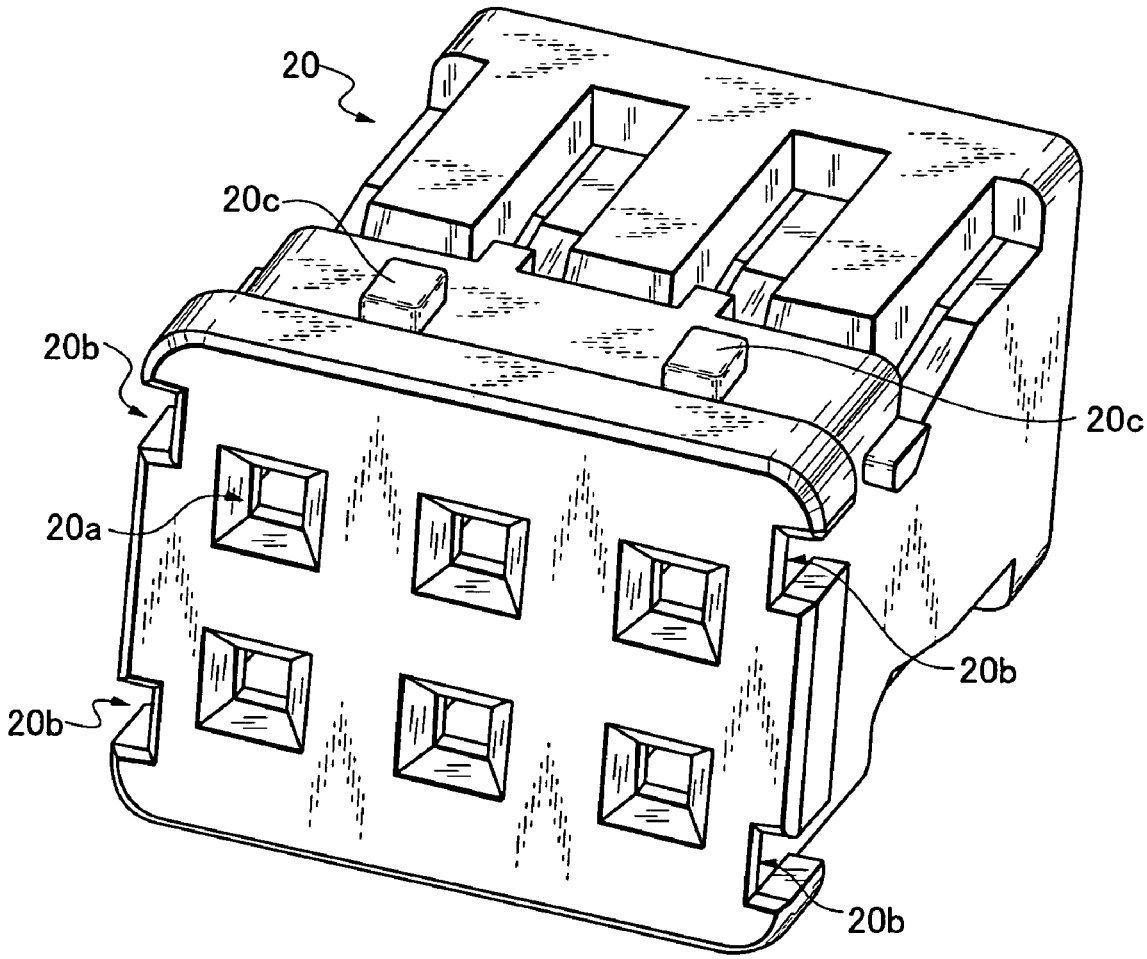
FIG. 6 is a perspective view showing an insulating member of the plug connector.

As shown in FIG. 6, the insulating member 20 is a mold member of a quadrangular shape and a front face thereof has the plurality of containing holes 20*a* opening therethrough. Core wires of the cable are respectively electrically connected to female contacts contained in the containing holes 20*a*. A front end side portion of the insulating member 20 is formed with guide grooves 20*b* for respectively engaging the engaging portions 14 of the mold case 10 at four locations, such that an upper portion and a lower portion of the mold case 10 divided by the slit 12 do not open in an up and down direction. Further, an upper face and a lower face of the front-end side are provided with engaging projections 20*c* for engaging with the shield case 30 at two respective portions thereof.

Figure 7A:
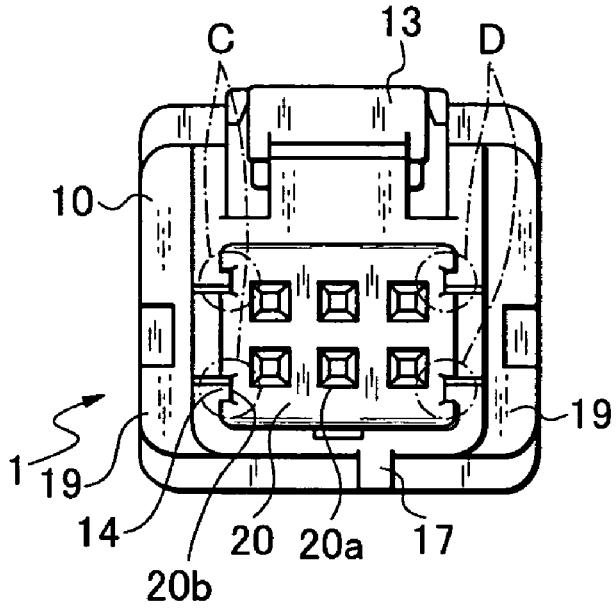
FIGS. 7A and 7B are a front view and a side view of the plug connector.
Figure 7B:
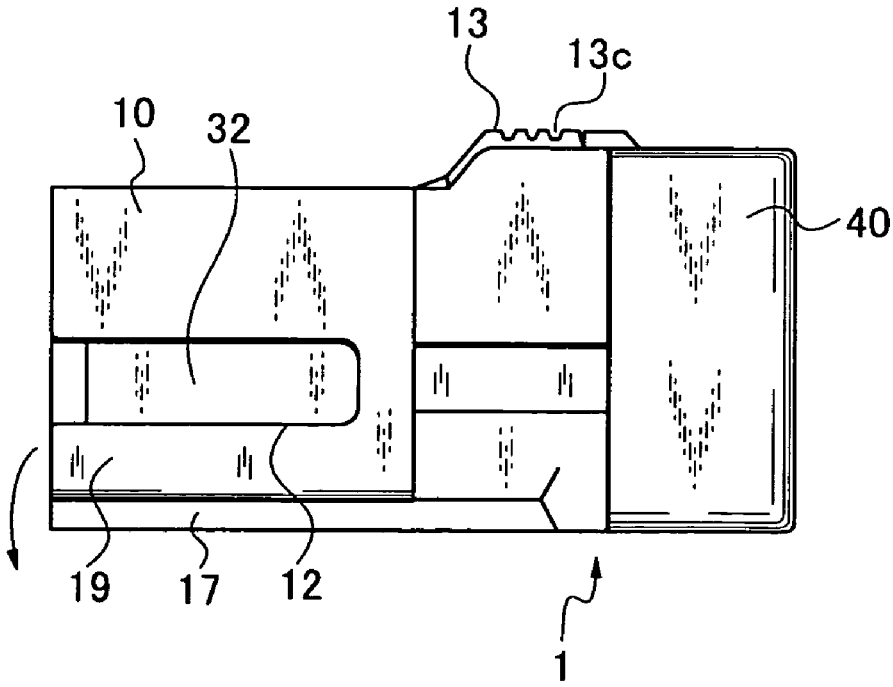

The shield case 30 is formed in a square cylinder shape, and upper and lower faces of the front end side are respectively formed with engaging holes 31 at positions corresponding with positions of the engaging projections 20*c* of the insulating member 20. When the insulating member 20 is inserted into the shield case 30, the engaging projections 20*c* are engaged with the engaging holes 31 to prevent separation of the insulating member 20 and shield case 30 in front and rear directions. When the assembly is mounted to the mold case 10, as shown in FIG. 7A, the engaging portions 14 at four portions of the front end portion of the mold case 10 are fitted into the guide grooves 20*b* at four locations of the front end portion of the insulating member 20 respectively substantially without gaps therebetween. As a result thereof, as is seen at locations C and D in FIG. 7A, the integral insulating member 20 made of a synthetic resin is restricted from being moved in the up and down direction and at the front portion of the mold case 10, opening of the lower portion 19 about the slit 12 is prevented.

Figure 8:
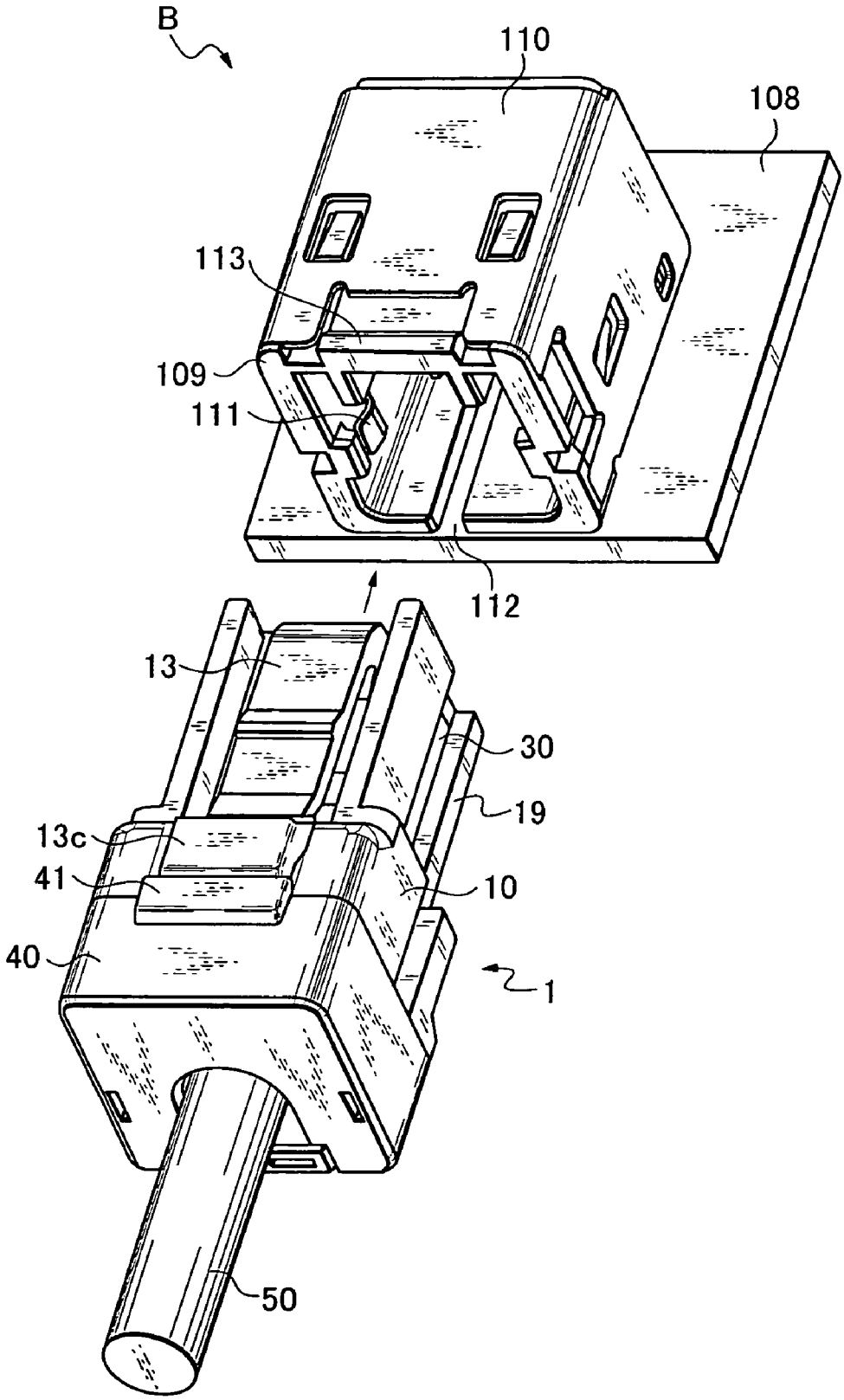
FIG. 8 is a perspective view showing a behavior of fitting the plug connector to an adaptor connector.
Figure 9:
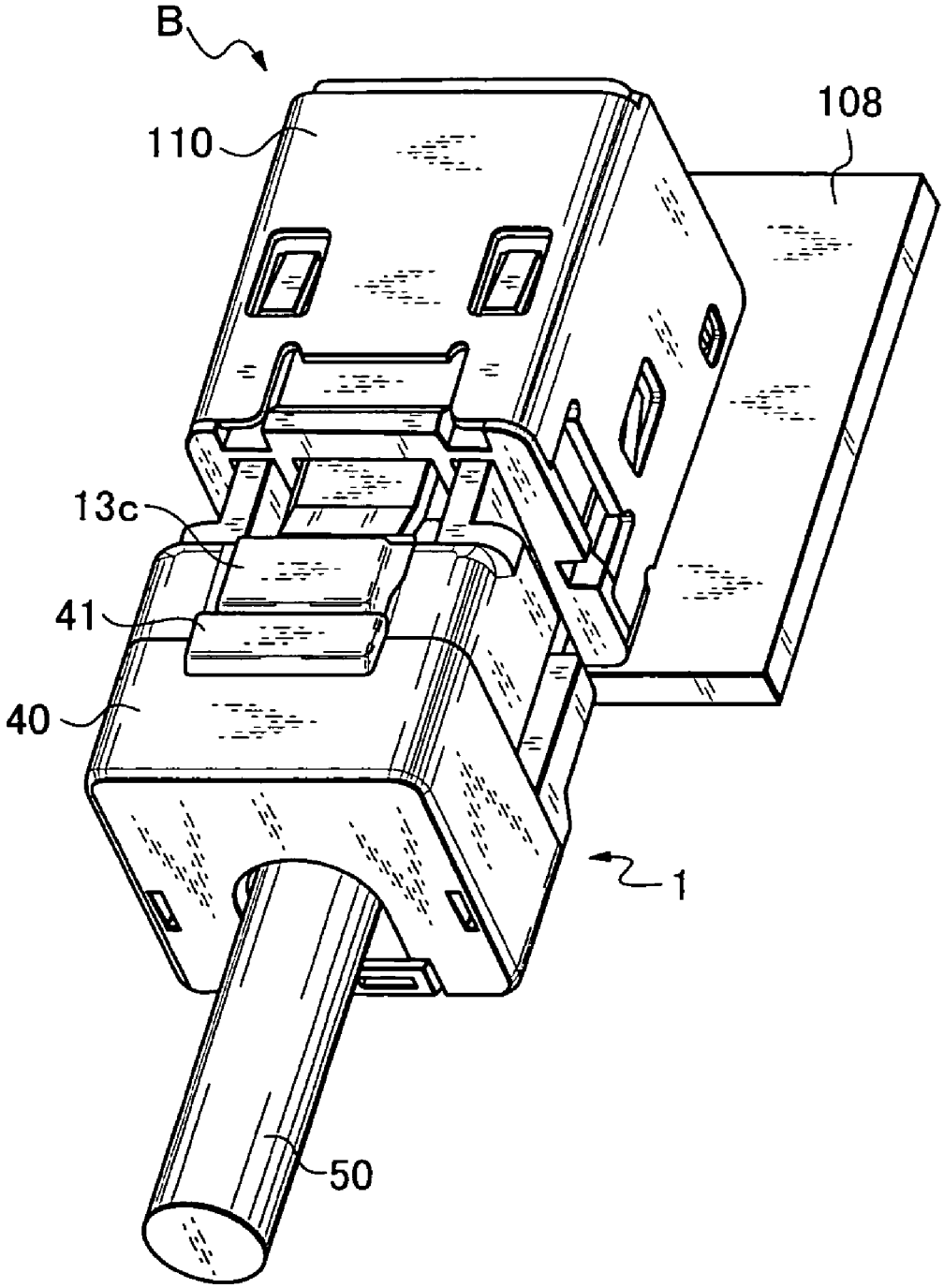
FIG. 9 is a perspective view showing a state of fitting the plug connector to the adaptor connector.
Figure 10:
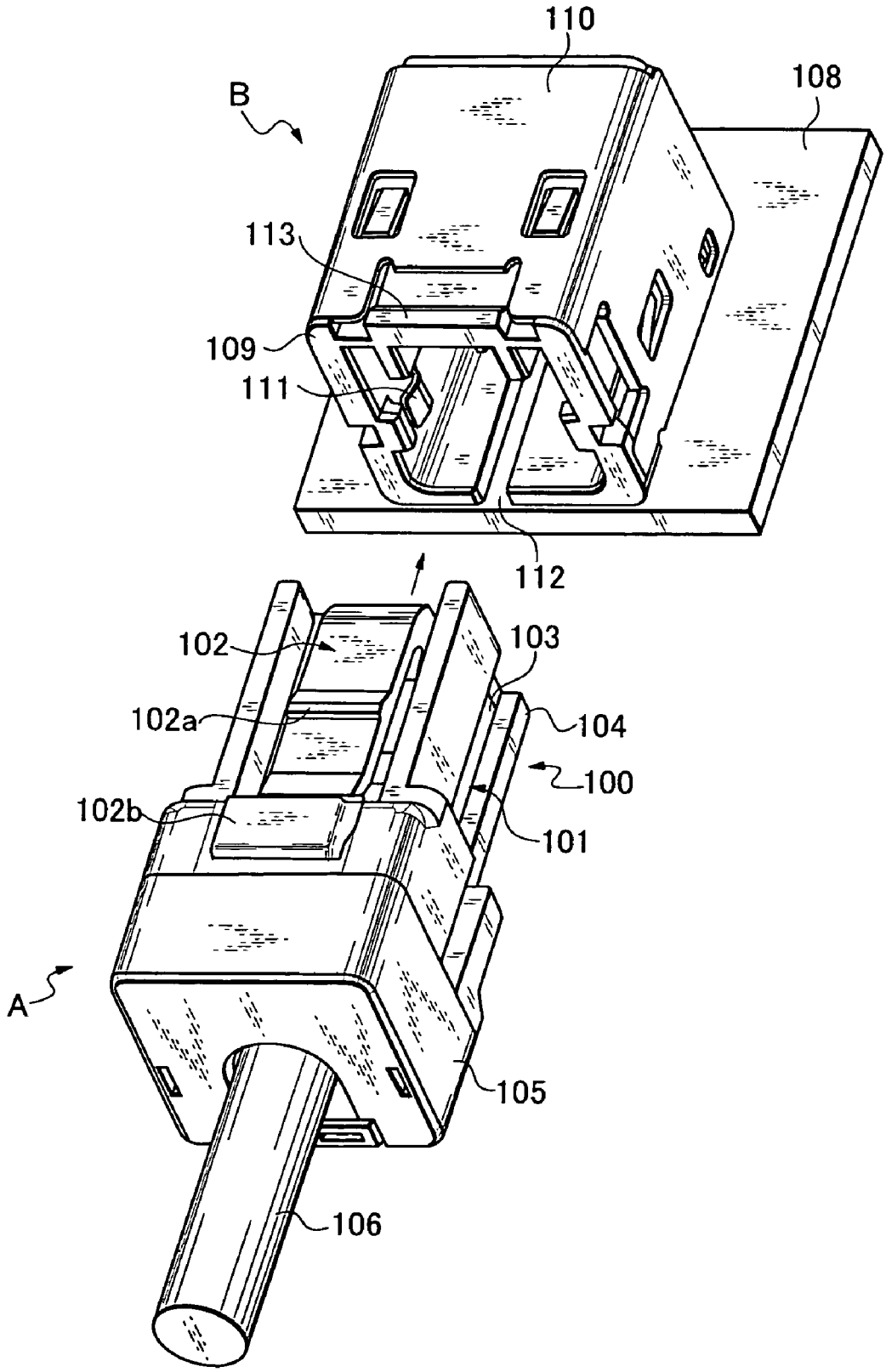
Fig. 10 PRIOR ART
FIG. 10 is a perspective view showing a behavior of fitting a prior art plug connector to an adaptor connector.
Figure 11A:
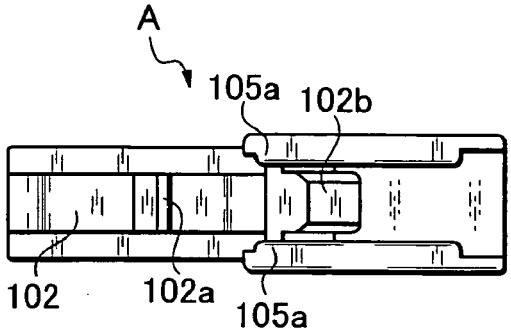
Fig. 11A PRIOR ART
FIGS. 11A, 11B, 11C, and 11D are a plan view, a partial front view, a partial rear view, and a partial side view of the plug connector of the prior art.
Figure 11B:
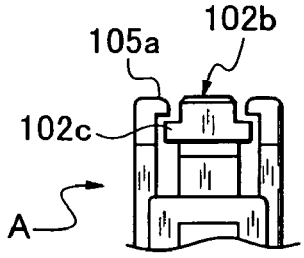
Fig. 11B PRIOR ART
Figure 11C:
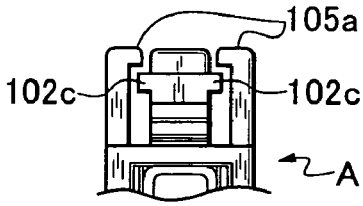
Fig. 11C PRIOR ART
Figure 11D:
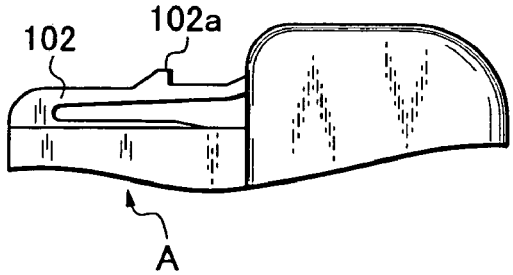
Fig. 11D PRIOR ART
Figure 12A:
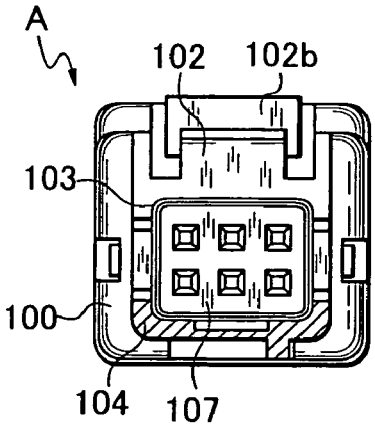
Fig. 12A PRIOR ART
FIGS. 12A and 12B are a front view and a side view of the plug connector of the prior art.
Figure 12B:
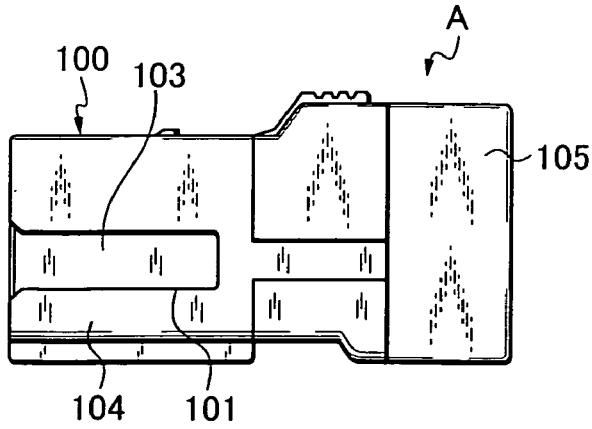
Fig. 12B PRIOR ART

As shown in FIG. 8 and FIG. 9, the retainer attached mold case 10 constituted as described above is assembled as a cable attached plug connector connected with a cable 50 and fitted to the adaptor connector "B" on the printed board 108 to be electrically connected therewith. When fitted, the lock portion 13*b* of the elastic claw 13 of the mold case 10 is locked by the lock portion 113 of the adaptor connector "B". When the lock release portion 13*c* is pressed downwardly, the locking state is released, and the plug connector 1 is released from the adaptor connector "B".

What is claimed is:

1. A plug connector having a retainer attached mold case, the plug connector comprising: an insulating member having aligned containing holes containing contacts; a shield case surrounding the insulating member excluding a front face thereof; a mold case substantially constituting a cylindrical case that accommodates the insulating member and the shield case at an inner space portion, two side walls of the mold case being formed with grounding slits open to communicate with a front end opening and an upper face of the mold case, the mold case including an elastic claw having a lock portion extended to a rear side by being turned back from a front end portion, and a lock release portion; and a retainer for closing a rear end opening of the mold case by excluding a cable inserting portion;

wherein a projection is projected to a rear side from a rear end portion of the elastic claw, and a float-preventing piece for preventing the elastic claw from floating up by being engaged with the projection is projected from a front-end portion of the retainer.

2. The plug connector according to claim 1, wherein inner wall faces of upper portions of two side walls of the mold case at the elastic claw are formed with engaging grooves extended in a front and rear direction, and engaging portions fitted to the engaging grooves are formed to project horizontally at two side walls of the float preventing piece.

3. The plug connector according to claim 1, wherein engaging portions projected to inner sides of the mold case for engaging with the insulating member are respectively provided on upper and lower sides of the opening edge portion of the mold case, a front end portion of the insulating member is formed with guide grooves respectively engaged with the engaging portions, and an upper portion and a lower portion of the mold case divided by the slit are prevented from being opened in an up and down direction.

4. The plug connector according to claim 2, wherein engaging portions projected to inner sides of the mold case for engaging with the insulating member are respectively provided on upper and lower sides of the opening edge portion of the mold case, a front end portion of the insulating member is formed with guide grooves respectively engaged with the engaging portions, and an upper portion and a lower portion of the mold case divided by the slit are prevented from being opened in an up and down direction.

* * * * *